US007494236B2

(12) United States Patent
Lim

(10) Patent No.: US 7,494,236 B2
(45) Date of Patent: Feb. 24, 2009

(54) SAFETY WARNING LIGHT EMITTER AND SAFETY UMBRELLA USING THE SAME

(75) Inventor: Seong-Kyu Lim, 7-202, Cheongun Mansion, 111-1, Daebong-dong, Jung-gu, Daegu (KR) 700-430

(73) Assignee: Seong-Kyu Lim, Daegu (KR)

( * ) Notice: Subject to any disclaimer, the term of this patent is extended or adjusted under 35 U.S.C. 154(b) by 118 days.

(21) Appl. No.: 11/577,418

(22) PCT Filed: Mar. 21, 2006

(86) PCT No.: PCT/KR2006/001024

§ 371 (c)(1),
(2), (4) Date: Apr. 18, 2007

(87) PCT Pub. No.: WO2006/101335

PCT Pub. Date: Sep. 28, 2006

(65) Prior Publication Data

US 2008/0068823 A1 Mar. 20, 2008

(30) Foreign Application Priority Data

Mar. 22, 2005 (KR) ..... 10-2005-0023749

(51) Int. Cl.
*A45B 3/02* (2006.01)
*A63B 15/02* (2006.01)

(52) U.S. Cl. ..... 362/102; 362/202; 362/800

(58) Field of Classification Search ..... 362/105, 362/102, 202–205; 135/910, 16
See application file for complete search history.

(56) References Cited

U.S. PATENT DOCUMENTS

| | | | | | |
|---|---|---|---|---|---|
| 6,135,605 | A * | 10/2000 | Hsu et al. | ..... | 362/102 |
| 6,157,451 | A * | 12/2000 | Mizuno | ..... | 356/394 |
| 6,267,481 | B1 * | 7/2001 | Yang | ..... | 362/102 |
| 6,305,819 | B1 * | 10/2001 | Chen | ..... | 362/186 |
| 6,382,809 | B1 * | 5/2002 | Ou-Yang | ..... | 362/102 |
| 2002/0121295 | A1 * | 9/2002 | Chen et al. | ..... | 135/16 |
| 2002/0144721 | A1 * | 10/2002 | Kronin et al. | ..... | 135/16 |
| 2003/0218876 | A1 * | 11/2003 | Wu | ..... | 362/102 |
| 2006/0118150 | A1 * | 6/2006 | Mattozzi | ..... | 135/16 |

* cited by examiner

*Primary Examiner*—Jong-Suk (James) Lee
*Assistant Examiner*—Leah S Lovell
(74) *Attorney, Agent, or Firm*—Lowe Hauptman Ham & Berner, LLP

(57) ABSTRACT

A safety warning light emitter (6) according to the present invention includes a button cover (12) tightly attached to a housing (8) at the bottom of an upper opening of the housing (8), a printed circuit board (20) located on the upper surface of a fixing member (30), the printed circuit board (20) having a light emission diode blink control chip mounted thereon, a push button (16) located on the printed circuit board (20), and a plurality of surface mounted device light emission diodes (26) connected to the printed circuit board (20). The fixing member (30) is fitted into the housing (8), while the surface mounted device light emission diodes (26) are positioned at the outside of the fixing member (30), and then the fixing member (30) is integrally fixed to the housing (8) by welding. A base (10), which has batteries (38) received therein, is coupled to the housing (8).

5 Claims, 7 Drawing Sheets

[Fig. 1]
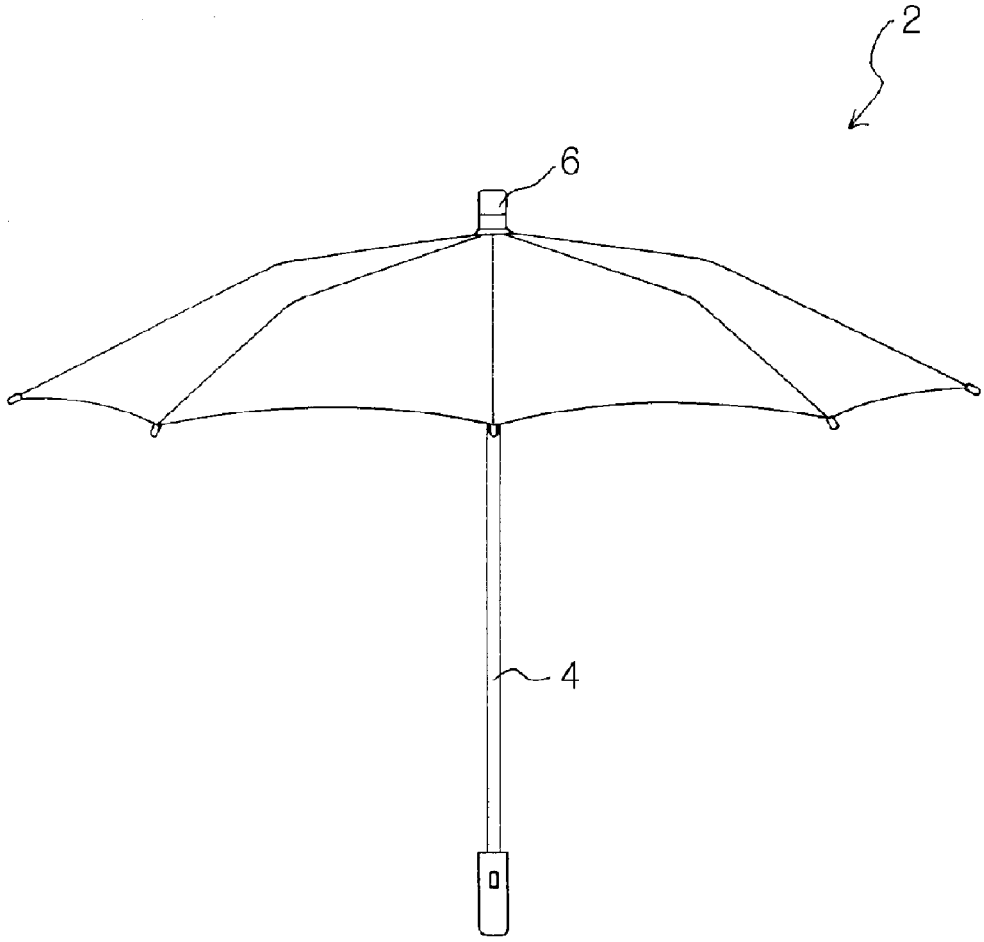
[Fig. 2]
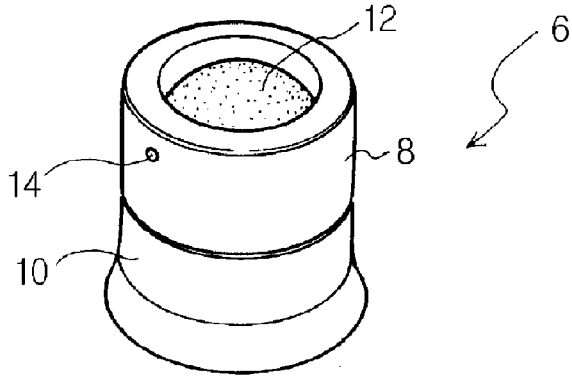

[Fig. 3]
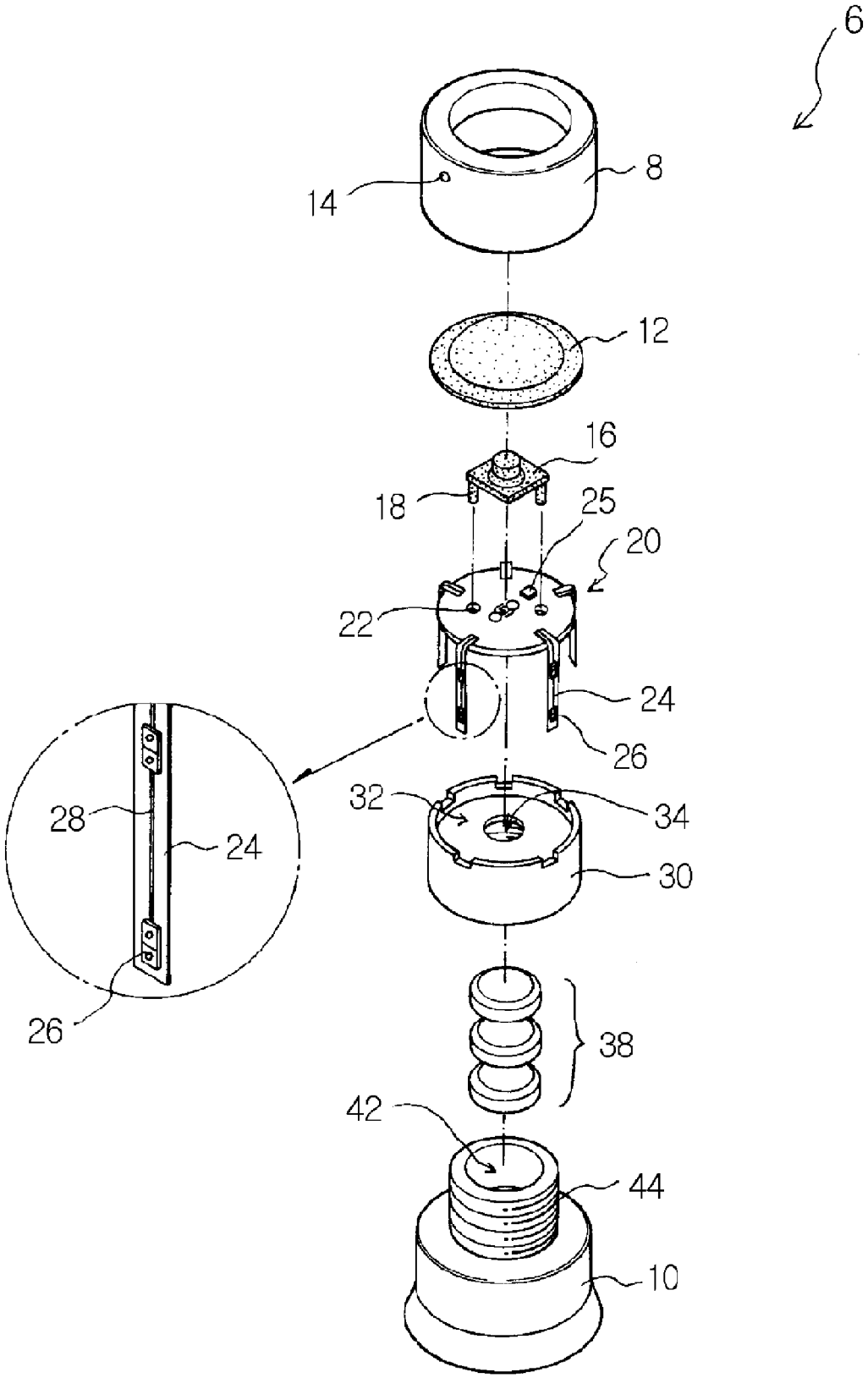

[Fig. 4]
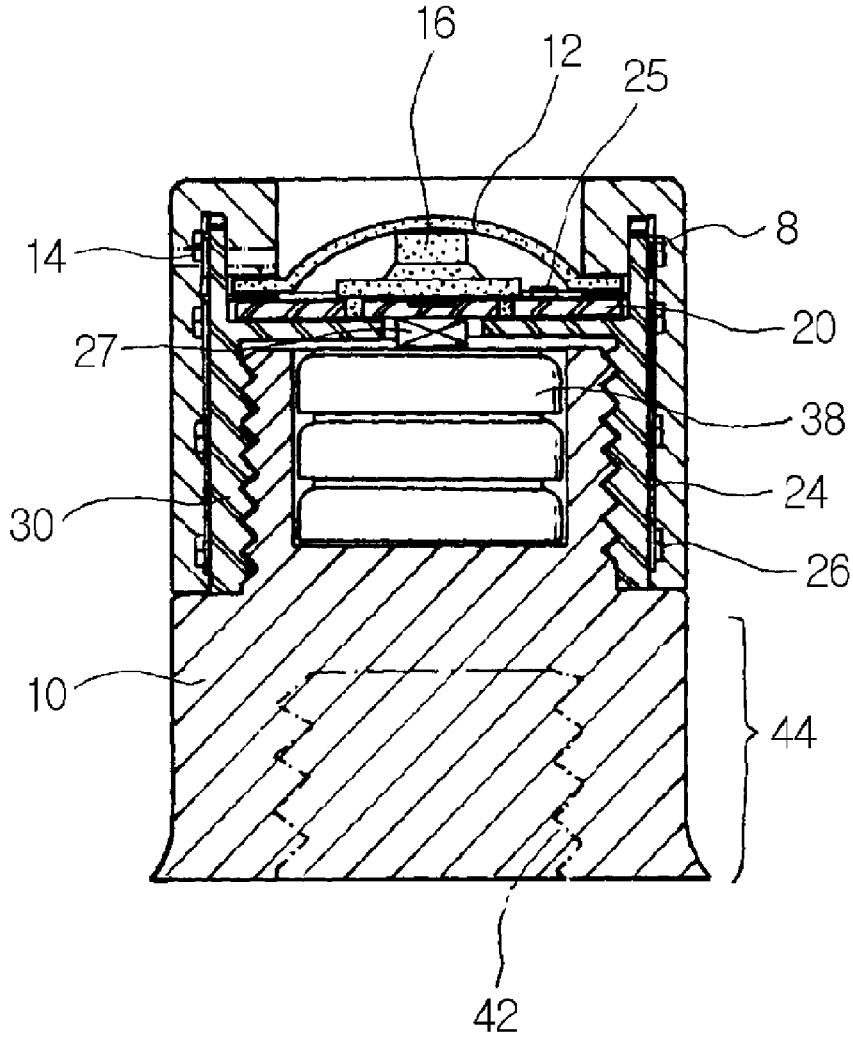
[Fig. 5]
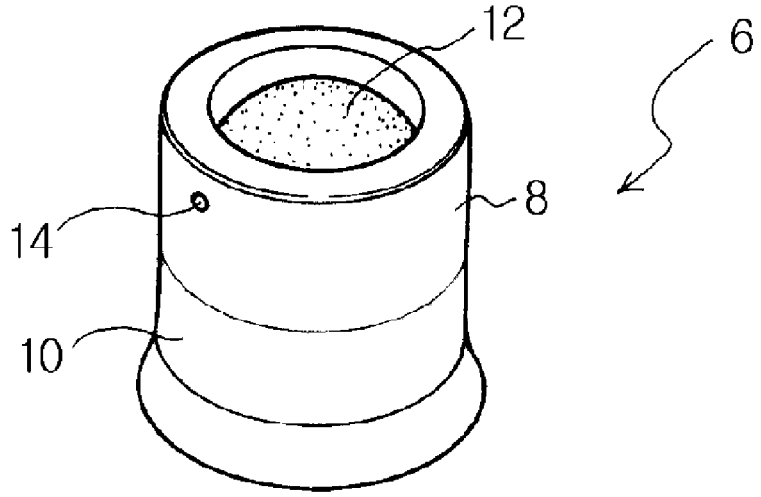

[Fig. 6]
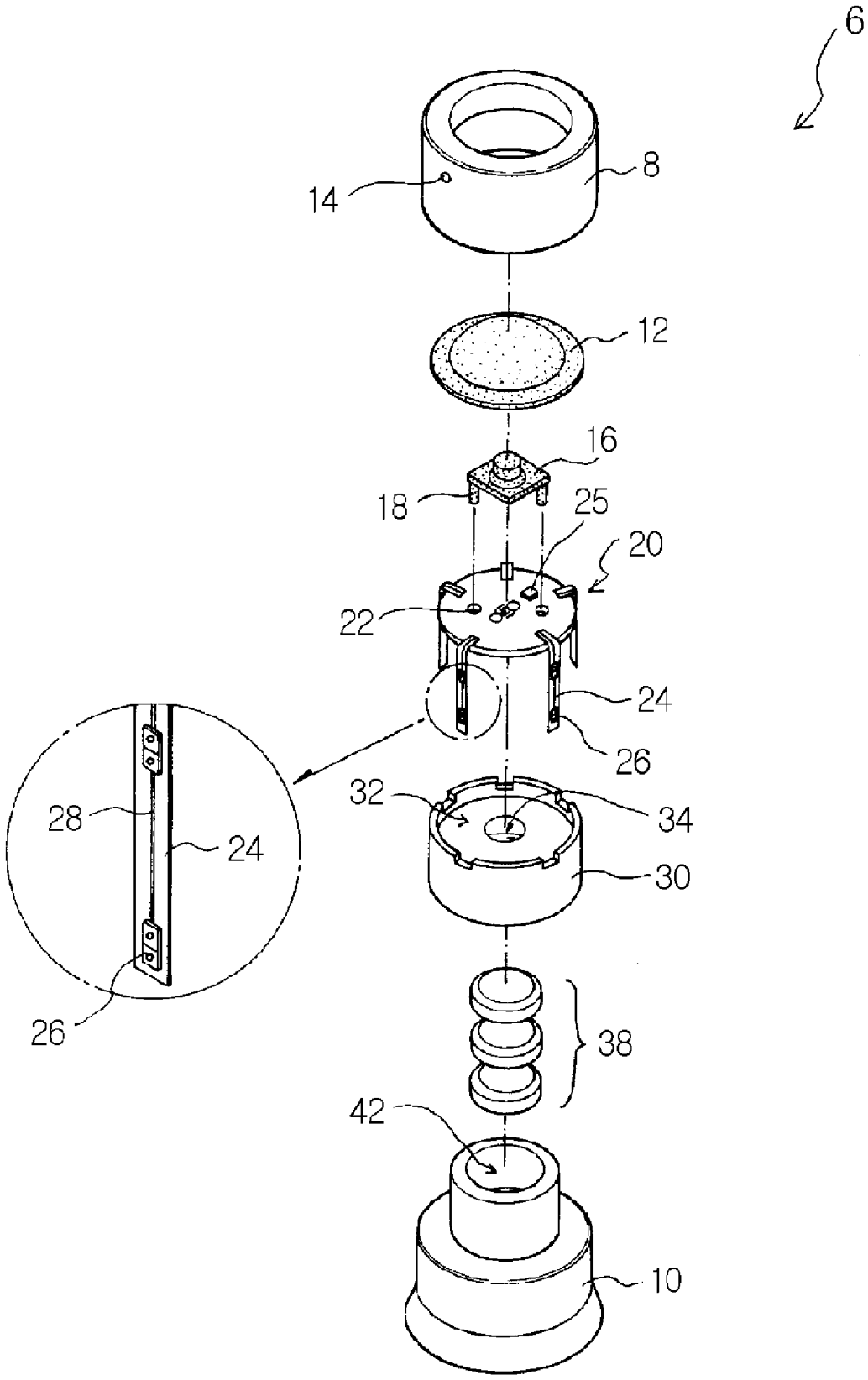

[Fig. 7]
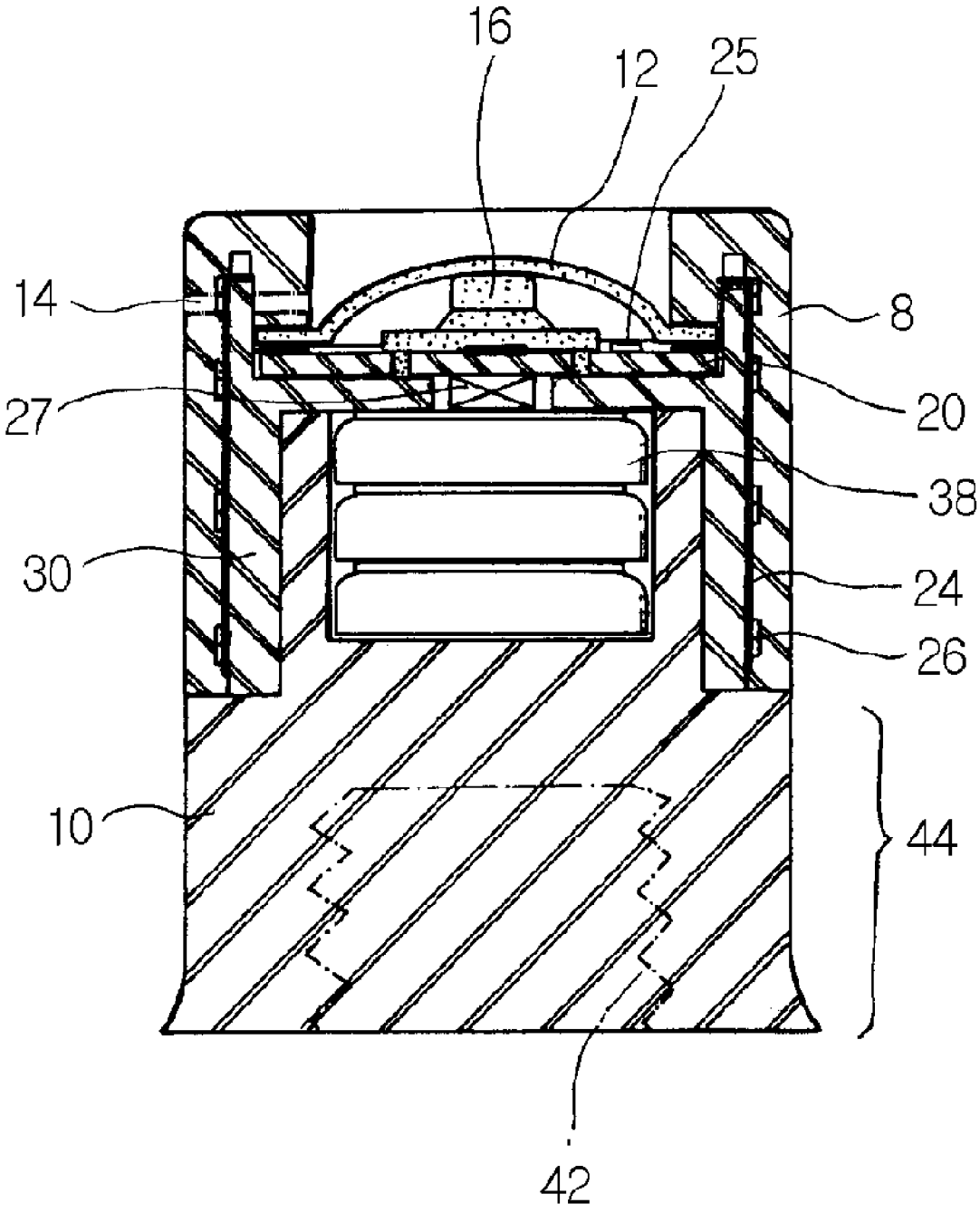

[Fig. 8]
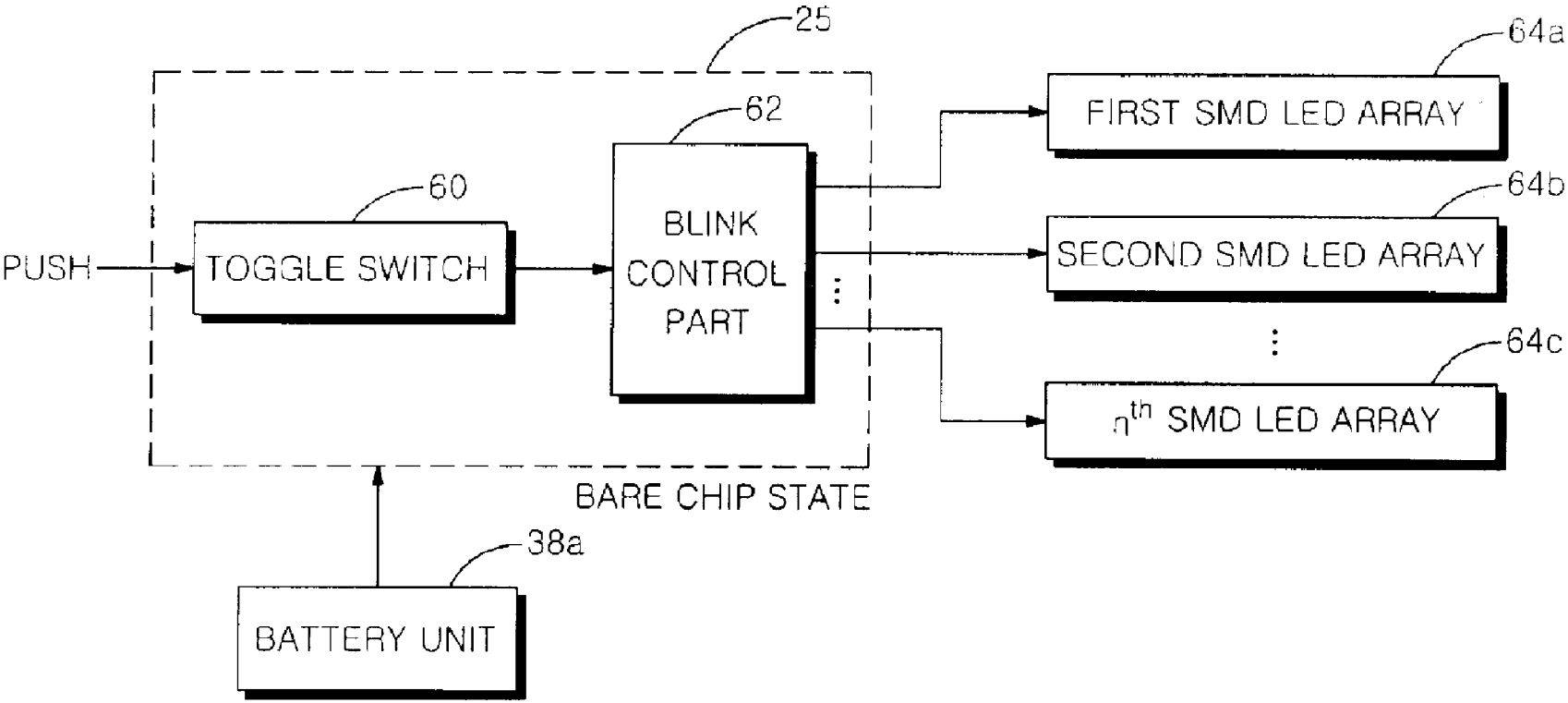

[Fig. 9]
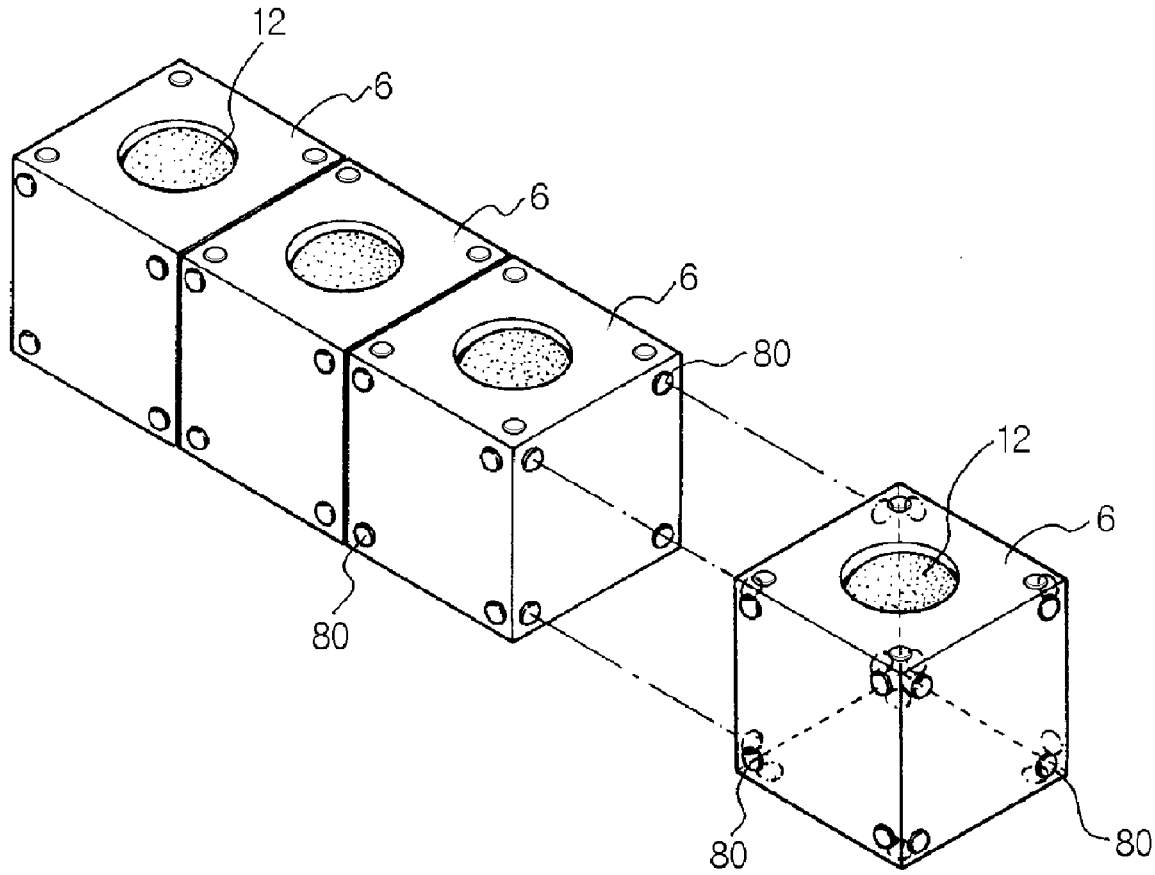

SAFETY WARNING LIGHT EMITTER AND SAFETY UMBRELLA USING THE SAME

CROSS REFERNCE TO RELATED APPLICATION

This application is the National Phase application of International Application No. PCT/KR2006/001024, filed Mar. 21, 2006, which designates the United States and was published in English. This application, in its entirety, is incorporated herein by reference.

TECHNICAL FIELD

The present invention relates to a light emitting device for safety, and, more particularly, to a safety warning light emitter for safety and a safety umbrella using the same.

BACKGROUND ART

Various kinds of umbrellas with different functions are currently used. Generally, umbrellas include a golf umbrella (long umbrella), a two-fold umbrella, a three-fold umbrella, a fashion umbrella, a children umbrella, etc.

When a rainy wind blows on a rainy day, people usually walk under umbrellas while the umbrellas are directed to the direction in which the rainy wind blows. In this case, people cannot look in front of them, whereby they easily may have an accident. Especially when people walk across a pedestrian crossing or walk along a road shoulder at night on a rainy day when a rainy wind blows, people under umbrellas and the drivers of traveling cars cannot see each other. Furthermore, when umbrellas are black and people under the umbrellas wear clothes having dark colors, it is very difficult for drivers of traveling cars to identify the pedestrians.

According to an example of safety umbrellas for protecting people from such danger, luminous cloths have been used for the safety umbrellas.

In addition of the safety umbrellas manufactured with such luminous cloths, various technologies have been proposed for coupling a light emitting device to the cap of an umbrella.

According to an example of the proposed technologies, a battery compartment is formed in the grip of an umbrella. In this case, it is necessary to arrange an electric wire from the battery compartment to an umbrella cap or the end of an umbrella support rib through a hollow part defined in an umbrella shaft. In the case of a long umbrella, however, the manufacturing costs are increased due to the arrangement of the electric wire, and therefore, it is not economic. In the case of a collapsible umbrella (a two-fold or three-fold umbrella), on the other hand, the electric wire arranged in the umbrella shaft is bent or crushed when the umbrella is folded.

According to another example of the proposed technologies, various sensors, such as a vibration sensor, a day/night sensor, and a water sensor, are used as an on/off device for light emission. In the case of using the vibration sensor, when a certain person waits for a signal light while he/she walks under an umbrella on a rainy day, an on-and-off light or an electric-light bulb of the umbrella is turned off, with the result that drivers of traveling cars cannot identify him/her. Furthermore, the manufacturing costs are increased, and therefore, it is not economic. In the case of using the day/night sensor, when the umbrella is located in a dark area although it does not rain, and therefore, the umbrella is not in use, the light emitting device continuously emits light or blinks on and off. As a result, the power consumption is increased. In the case of using the water sensor, the light emitting device continuously emits light or blinks on and off until the wet umbrella is dried. In this way, the umbrella may malfunction. Furthermore, the power consumption is increased.

As yet another example of the proposed technologies, a light emitting device of an umbrella cap is disclosed in Korean Unexamined Utility Model Publication No. 20-1996-6874, in which a case-shaped thread part having a battery received therein and a light emitter is mounted in a transparent cap such that the light emitter is turned on and off by fastening and loosening the thread part.

However, the size of the light emitting device of the umbrella cap is large. As a result, the light emitting device of the umbrella cap is adopted only for long umbrellas. Furthermore, the light emitting device of the umbrella cap is easily broken. In addition, since the light is turned on and off by fastening and loosening the thread part, water or moisture leaks through a gap in the thread part, and therefore, the battery may be deteriorated.

DISCLOSURE OF INVENTION

Technical Problem

When a safety warning light emitting device can be adopted for long umbrellas and collapsible umbrellas (two-fold or three-fold umbrellas) without restriction, can protect people under the umbrellas from danger, can provide warning, pleasure, and interest to users of the umbrellas, the safety warning light emitting device will become the focus of consumers' attention. Furthermore, a safety warning light emitting device is required that can be adopted for various applications in addition to the umbrellas.

Therefore, it is an object of the present invention to provide a safety warning light emitter for protecting people from danger, and a safety umbrella using the same.

It is another object of the present invention to provide a safety warning light emitter that can protect people from danger and provide pleasure and interest to people, and a safety umbrella using the same.

It is another object of the present invention to provide a safety warning light emitter that can be manufactured with a small size corresponding to the size of the umbrella cap of a collapsible umbrella (a two-fold or three-fold umbrella), and a safety umbrella using the same.

It is yet another object of the present invention to provide a safety warning light emitter that can be arranged in an enlarged scale, whereby the safety warning light emitter is more clearly recognized by the other party.

Technical Solution

In accordance with one aspect of the present invention, the above and other objects can be accomplished by the provision of a safety warning light emitter comprising: a button cover tightly attached to a housing at the bottom of an upper opening of the housing; a printed circuit board, located on the upper surface of a fixing member, the printed circuit board having a light emission diode blink control chip mounted thereon; a push button located on the printed circuit board; a plurality of surface mounted device light emission diodes connected to the printed circuit board; the fixing member being fitted into the housing, while the surface mounted device light emission diodes are positioned at the outside of the fixing member, and then the fixing member being integrally fixed to the housing by welding; and a base coupled to the housing, the base having batteries received therein.

In accordance with another aspect of the present invention, there is provided a safety umbrella having a safety warning light emitter coupled to the upper end of an umbrella shaft thereof, wherein the safety warning light emitter comprises: a button cover tightly attached to a housing at the bottom of an upper opening of the housing; a printed circuit board, located on the upper surface of a fixing member, the printed circuit board having a light emission diode blink control chip mounted thereon; a push button located on the printed circuit board; a plurality of surface mounted device light emission diodes connected to the printed circuit board; the fixing member being fitted into the housing, while the surface mounted device light emission diodes are positioned at the outside of the fixing member, and then the fixing member being integrally fixed to the housing by welding; and a base coupled to the housing, the base having batteries received therein.

Advantageous Effects

The present invention has the effect of preventing accidents through safety warning light emission, improving pleasure and interest, and guaranteeing greater security of life when the present invention is adopted for safety umbrellas.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a view illustrating a safety umbrella, to which a safety warning light emitter according to the present invention is coupled;

FIGS. 2 to 4 illustrate a battery-replacement type safety warning light emitter according to a preferred embodiment of the present invention, which is adopted for umbrellas, wherein FIG. 2 is a view illustrating the external appearance of the battery-replacement type safety warning light emitter, FIG. 3 is an exploded perspective view illustrating the battery-replacement type safety warning light emitter, and FIG. 4 is a sectional view illustrating the battery-replacement type safety warning light emitter;

FIGS. 5 to 7 illustrate an integration type safety warning light emitter according to another preferred embodiment of the present invention, which is adopted for umbrellas, wherein FIG. 5 is a view illustrating the external appearance of the integration type safety warning light emitter, FIG. 6 is an exploded perspective view illustrating the integration type safety warning light emitter, and FIG. 7 is a sectional view illustrating the integration type safety warning light emitter;

FIG. 8 is a circuit block diagram of the safety warning light emitter according to the present invention; and FIG. 9 is a perspective view illustrating an example of a safety warning light emitting stick constituted by a plurality of safety warning light emitters.

MODE FOR THE INVENTION

Now, preferred embodiments of the present invention will be described in detail with reference to the accompanying drawings. In the drawings, the same or similar elements are denoted by the same reference numerals even though they are depicted in different drawings. In the following, a detailed description of known functions and configurations incorporated herein will be omitted when it may make the subject matter of the present invention rather unclear.

FIG. 1 is a view illustrating a safety umbrella 2, to which a safety warning light emitter 6 according to the present invention is coupled. Instead of a conventional coupling cap, the safety warning light emitter 6 according to the present invention is coupled to the upper end of an umbrella shaft 4 of the safety umbrella 2.

It is possible that, when the safety warning light emitter 6 according to the present invention, which is adopted for the safety umbrella 2, is manufactured with the minimum size, the safety warning light emitter has a size of 10 mm in height× 10 mm in width, and the safety warning light emitter 6 has a weight of over 10 grams. That is, the safety warning light emitter 6 has a small volume and a light weight. Consequently, it is easy and convenient to carry or transport the safety warning light emitter 6 according to the present invention. The safety warning light emitter 6 according to the present invention is constructed such that the safety warning light emitter 6 can continuously emit light or blink on and off at a high brightness level in various color tones (bright red, blue, orange, white, etc.) when the safety warning light emitter 6 is turned on.

FIGS. 2 and 5 illustrates examples of safety warning light emitters 6, which are adopted for the safety umbrella 2, and FIG. 9 is a perspective view illustrating an example of a safety warning light emitter 6, which can be used for various purposes.

The safety warning light emitters 6 according to the present invention are classified into a battery-replacement type safety warning light emitter in which the battery replacement is possible and an integration type safety warning light emitter in which the battery replacement is not possible. The battery-replacement type safety warning light emitter 6, which is adopted for the safety umbrella 2, is illustrated in FIGS. 2 to 4, and the integration type safety warning light emitter 6, which is also adopted for the safety umbrella 2, is illustrated in FIGS. 5 to 7.

In the drawings illustrating the battery-replacement type safety warning light emitter 6 (FIGS. 2 to 4), FIG. 2 is a view illustrating the external appearance of the battery-replacement type safety warning light emitter 6, FIG. 3 is an exploded perspective view illustrating the battery-replacement type safety warning light emitter 6, and FIG. 4 is a sectional view illustrating the battery-replacement type safety warning light emitter 6. In the drawings illustrating the integration type safety warning light emitter 6 (FIGS. 5 to 7), FIG. 5 is a view illustrating the external appearance of the integration type safety warning light emitter 6, FIG. 6 is an exploded perspective view illustrating the integration type safety warning light emitter 6, and FIG. 7 is a sectional view illustrating the integration type safety warning light emitter 6.

The battery-replacement type safety warning light emitter 6 illustrated in FIGS. 2 to 4 has an advantage in that a used battery can be replaced with a new one. On the other hand, the integration type safety warning light emitter 6 illustrated in FIGS. 5 to 7 has an advantage in that the interior of the safety warning light emitter is hermetically sealed, and therefore, a built-in battery is safe.

First, the construction of the battery-replacement type safety warning light emitter 6, which is adopted for the safety umbrella 2, will be described in detail with reference to FIGS. 2 to 4.

The safety warning light emitter 6 is made of a synthetic resin, plastic. The safety warning light emitter 6 is formed in the shape of a cylinder, which is somewhat similar to the conventional coupling cap. A button cover 12 is tightly attached to a housing 8 at the bottom of an upper opening of the housing 8. A user of the safety umbrella 2 can insert the end of a finger through the upper opening of the housing 8 to push the button cover 12. The button cover 12 is made of a synthetic material softer than that of the housing 8. The button cover 12 is tightly attached to the housing 8 at the bottom of the upper opening of the housing 8 by ultrasonic welding or thermal welding, whereby the interior of the housing 8 is hermetically sealed.

The button cover 12 disposed at the bottom of the upper opening of the housing 8 prevents undesirable switching on/off of the safety warning light emitter 6 when the safety warning light emitter 6 collides with an external object or the ground. At one side of the housing 8 adjacent to the upper opening of the housing 8 is optionally formed a water drainage hole 14, which is bored through the housing 8. Rainwater gathered in the upper opening of the housing 8 is drained out of the housing 8 through the water drainage hole 14.

Referring to the exploded perspective view of FIG. 3, a fixing member 30 is inserted into the housing 8, and is then fixed to the housing 8 by welding. The fixing member 30 is formed in the shape of a cylinder. On the upper surface 32 of the fixing member 30 is located a printed circuit board 20, on which a light emission diode blink control chip 25 is mounted in a bare chip state. On the printed circuit board 20 is located a push button 16. The push button 16 has fixing protrusions 18, which are made of a soft material. The fixing protrusions 18 of the push button 16 are inserted through fixing holes 22 of the printed circuit board 20, which is formed in the shape of a circle, such that the pressing point of the push button 16 correspond to the contacting point of the printed circuit board 20.

The circular printed circuit board 20 is a thin board having a thickness of approximately 0.1 to 1 mm. A circuit pattern is formed on the board. The light emission diode blink control chip 25, which is mounted on the circular printed circuit board 20 in the bare chip state, has a thickness of approximately 0.1 to 1 mm. Also, the light emission diode blink control chip 25 has a width of approximately 1 to 2 mm. The light emission diode blink control chip 25 serves to control the light emission of surface mounted device light emission diodes (hereinafter, referred to as "SMD LEDs") 26, which continuously emit light or blink on and off in various color tones. The construction of the light emission diode blink control chip 25 will be described hereinafter in detail with reference to FIG. 8.

To the circuit pattern of the printed circuit board 20 are connected a plurality of flexible printed circuit cables 24. Conductive film lines 28 of the flexible printed circuit cables 24 are electrically connected to the light emission diode blink control chip 25.

The flexible printed circuit cables 24 are radially arranged and extend downward from the outer circumference of the printed circuit board 20. A pair of SMD LEDs 26 are disposed on each flexible printed circuit cable 24 such that the SMD LEDs 26 are spaced a predetermined distance from each other. Many pairs of SMD LEDs 26 are electrically connected with each other. It is preferable that the respective SMD LEDs 26 have different color tones and a high brightness level of 10 to 30 candela (cd).

When the circular printed circuit board 20 is placed on the upper surface 32 of the fixing member 30, the plurality of SMD LEDs 26 are positioned at the outside of the fixing member 30, and an electrode contact 27 (see FIG. 4) protrudes downward through a through-hole of the fixing member 30. In this state, the fixing member 30 is fitted into the housing 8, and is then fixed to the housing 8 by ultrasonic welding or thermal welding. As a result, the fixing member 30 is integrally fixed to the housing 8. Consequently, the push button 16 and the printed circuit board 20 are securely located on the upper surface 32 of the fixing member 30, and the interior of the housing 8 is hermetically sealed.

The surface of the fixing member 30 may be formed in various color tones and designs. However, it is preferable that the housing 8 be made of a transparent material or a semi-transparent material, through which light emitted from the SMD LEDs 26 is transmitted without interception.

On the other hand, a base 10 is provided with a battery compartment 42, in which batteries 38 are received. After the batteries 38 are received in the battery compartment 42 of the base 10, a male thread part 44 of the base 10 is threadedly engaged into a female thread part 34 of the fixing member 30, which is integrated with the housing 8. As a result, the assembly of the safety warning light emitter 6, which is adopted for the safety umbrella 2, is completed. The threaded engagement according to this preferred embodiment is performed only when the battery replacement is required. Consequently, the threaded engagement for the battery replacement has higher sealing efficiency than the threaded engagement for on and off switch.

As shown in FIG. 4, the base 10 is provided at the lower part thereof with a reserve part 44, in which a threaded groove 42 is formed such that a thread part of the upper end of the umbrella shaft 4 is threadedly engaged into the threaded groove 42.

The threaded groove 42 of the reserve part 44 may be formed by umbrella manufacturing companies based on predetermined sizes after the safety warning light emitter 6 according to the present invention is completed as a finished product. In this case, it is preferable that a threaded groove forming point be marked on the bottom surface of the base 10, whereby the threaded groove can be easily formed by the respective umbrella manufacturing companies.

On the other hand, the reserve part 44 may be processed such that the reserve part 44 can be tightly fitted onto the coupling cap of the umbrella instead of forming the threaded groove 42 in the reserve part 44 such that the thread part of the upper end of the umbrella shaft 4 is threadedly engaged into the threaded groove 42. Also, it should be appreciated that the reserve part 44 may be removed when the safety warning light emitter according to the present invention is not adopted for umbrellas.

FIG. 8 is a circuit block diagram of the safety warning light emitter 6 according to the present invention. The circuit block of the safety warning light emitter 6 according to the present invention includes the light emission diode blink control chip 25, which is mounted in the bare chip state as shown in FIG. 3, SMD LED arrays 64*a*, 64*b* . . . 64*c*, and a battery unit 38*a*.

The battery unit 38*a* is constructed using one or more batteries 38 as shown in FIG. 3. When the safety warning light emitter 6 is to be manufactured with the minimum size, it is most preferable that the battery unit 38*a* be constructed using only one battery. The batteries 38 of the battery unit 38*a* supply a DC current to the light emission diode blink control chip 25 via the electrode contact 27.

The light emission diode blink control chip 25 comprises a toggle switch 60 and a blink control part 62. The toggle switch 60 serves as a connection switch for alternately switching on and off a light whenever a user pushes the push button 16. The blink control part 62 has information on light emission control and continuous or blinking light emission control cycles for the respective SMD LED arrays 64*a*, 64*b* . . . 64*c*, which are programmed in an internal memory thereof. The blink control part 62 controls the light emission of the respective SMD LED arrays 64*a*, 64*b* . . . 64*c* based on the predetermined program according to the ON control of the toggle switch 60.

When the user pushes the button cover of the safety warning light emitter 6 with the above-stated construction using the tip of a finger, light is emitted from the SMD LED arrays 64*a*, 64*b* . . . 64*c*. When the user again pushes the button cover of the safety warning light emitter 6, emission of light from the SMD LED arrays 64*a*, 64*b* . . . 64*c* is interrupted.

Referring to FIGS. 5 to 7, which illustrate an integration type safety warning light emitter according to another preferred embodiment of the present invention, which is adopted for the umbrella 2, this embodiment is characterized in that the male thread part 44 of the base 10 and the female thread part 34 of the fixing member 30 are removed, but the housing 8 is integrally fixed to the base 10 by ultrasonic welding or thermal welding while the batteries 38 are disposed between the housing 8 and the base 100 in a hermetically sealed state instead.

In the integration type safety warning light emitter shown in FIGS. 5 to 7, the battery replacement is not possible; however, the sealed state of the batteries and the circuit parts is reliably guaranteed.

The safety warning light emitter 6 according to the present invention may be manufactured in various shapes, such as a heart, a star, a flower, a butterfly, a soccer ball, etc, whereby the safety warning light emitter may stimulate imagination and curiosity of elementary school children or infants.

FIG. 9 is a perspective view illustrating an example of a safety warning light emitter 6, which is constructed in the shape of a hexahedron, according to the present invention.

Referring to FIG. 9, a plurality of hexahedral safety warning light emitters 6 constitute a safety warning light emitting stick. Each hexahedral safety warning light emitter 6 has magnet pieces 80, which are buried in all the corners of each facet of the hexahedron. Consequently, the user can use the hexahedral safety warning light emitters 6 in various shapes as occasion demands.

For example, as shown in FIG. 9, the safety warning light emitters 6 may be connected with each other, in the shape of a vertical line or a horizontal line, by means of the magnet pieces 80 mounted in all the corners of the safety warning light emitters 6, such that the safety warning light emitters 6 can be used as a safety warning light emitting stick. Alternatively, the safety warning light emitters 6 may be attached to a steel plate such that the safety warning light emitters 6 can be used as a safety warning sign.

Also, the safety warning light emitters 6 may be attached to a cultivator or a bicycle. In addition, the safety warning light emitters 6 may be used as night safety warning signs at danger areas of a constriction site, for example, at depressions in the ground.

Although the safety warning light emitter according to this embodiment of the present invention is constructed in the shape of a hexahedron as shown in FIG. 9, the safety warning light emitter may be constructed in the shape of a polyhedron including a tetrahedron, such as a triangular pyramid, or more. Of course, the magnet pieces 80 may be buried in the respective facets of the polyhedron.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

INDUSTRIAL APPLICABILITY

The present invention can be adopted for umbrellas, or can be used as various safety warning signs.

The invention claimed is:

1. A safety warning light emitter comprising:

a button cover (12) tightly attached to a transparent housing (8) at the bottom of an upper opening of the housing (8);

a thin printed circuit board (20) located on the upper surface of a fixing member (30), the printed circuit board (20) having a light emission diode blink control chip (25) mounted thereon in a bare chip state;

a push button (16) located on the printed circuit board (20);

a plurality of flexible printed circuit cables (24) connected to the printed circuit board (20);

a plurality of surface mounted device light emission diodes (26) attached to conductive film lines (28) of the flexible printed circuit cables (24);

the fixing member (30) being fitted into the housing (8), while the plurality of flexible printed circuit cables (24) are positioned at the outside of the fixing member (30), and then the fixing member (30) being integrally fixed to the housing (8) by welding; and a base (10) coupled to the fixing member (30), which is integrally fixed to the housing (8), the base (10) having batteries (38) received therein, whereby the light emission diode blink control chip (25) controls continuous and blinking light emission of the surface mounted device light emission diodes (26) in various color tones when a switch is turned on.

2. The safety warning light emitter as set forth in claim 1, further comprising:

a reserve part (44) provided at the lower part of the base (10), the reserve part (44) being able to be utilized after the safety warning light emitter is completed as a finished product.

3. The safety warning light emitter as set forth in claim 1, wherein the safety warning light emitter is constructed in the shape of a polyhedron including a tetrahedron or more, and the safety warning light emitter further comprises: magnet pieces (80) buried in corners of the polyhedron.

4. A safety umbrella having a safety warning light emitter coupled to the upper end of an umbrella shaft (4) thereof, wherein the safety warning light emitter (6) comprises:

a button cover (12) tightly attached to a transparent housing (8) at the bottom of an upper opening of the housing (8);

a thin printed circuit board (20) located on the upper surface of a fixing member (30), the printed circuit board (20) having a light emission diode blink control chip (25) mounted thereon in a bare chip state;

a push button (16) located on the printed circuit board (20);

a plurality of flexible printed circuit cables (24) connected to the printed circuit board (20);

a plurality of surface mounted device light emission diodes (26) attached to conductive film lines (28) of the flexible printed circuit cables (24);

the fixing member (30) being fitted into the housing (8), while the plurality of flexible printed circuit cables (24) are positioned at the outside of the fixing member (30), and then the fixing member (30) being integrally fixed to the housing (8) by welding; and a base (10) coupled to the fixing member (30), which is integrally fixed to the housing (8), the base (10) having batteries (38) received therein, whereby the light emission diode blink control chip (25) controls continuous and blinking light emission of the surface mounted device light emission diodes (26) in various color tones when a switch is turned on.

5. The safety umbrella as set forth in claim 4, wherein the base (10) and the housing (8) of the safety warning light emitter (6) are coupled to each other in a hermetically sealed state by welding.

* * * * *